US007833045B2

(12) United States Patent
Bishop

(10) Patent No.: US 7,833,045 B2
(45) Date of Patent: Nov. 16, 2010

(54) INSULATION DISPLACEMENT CONNECTOR (IDC)

(75) Inventor: Peter Bishop, Cambridgeshire (GB)

(73) Assignee: AVX Corporation, Myrtle Beach, SC (US)

( * ) Notice: Subject to any disclaimer, the term of this patent is extended or adjusted under 35 U.S.C. 154(b) by 0 days.

(21) Appl. No.: 12/369,381

(22) Filed: Feb. 11, 2009

(65) Prior Publication Data

US 2009/0239409 A1 Sep. 24, 2009

Related U.S. Application Data

(60) Provisional application No. 61/038,889, filed on Mar. 24, 2008.

(51) Int. Cl.
*H01R 4/24* (2006.01)

(52) U.S. Cl. ..... 439/404

(58) Field of Classification Search ..... 439/404, 439/405, 402, 940, 942, 83
See application file for complete search history.

(56) References Cited

U.S. PATENT DOCUMENTS 3,854,114 A * 12/1974 Kloth et al. ..... 439/398
4,227,763 A * 10/1980 Marks ..... 439/404
4,836,803 A * 6/1989 Seidel ..... 439/447
5,188,536 A * 2/1993 Ganthier et al. ..... 439/83
5,199,896 A * 4/1993 Mosquera ..... 439/329
5,478,248 A * 12/1995 Mitra et al. ..... 439/74
5,577,930 A * 11/1996 Dahlem et al. ..... 439/399
5,616,047 A * 4/1997 Lutsch ..... 439/397
5,997,337 A * 12/1999 Torii ..... 439/399
6,019,637 A * 2/2000 Iwata et al. ..... 439/595
6,050,845 A 4/2000 Smalley, Jr. et al.
6,093,048 A * 7/2000 Arnett et al. ..... 439/404
6,135,821 A * 10/2000 Liu ..... 439/676
6,285,815 B1 * 9/2001 Daoud ..... 385/137
7,320,616 B1 1/2008 Legrady et al.

OTHER PUBLICATIONS

Jaycar Electronics Reference Data Sheet: IDCONNJ.PDF (1) "IDC Cable, Headers, & Connectors", 2004.
Http://www.ETCO.Com/releases: Press Release:"IDC Terminals Provide One-Step Attachment", 2006.
Http://www.wppltd.demon.co.uk/WPP/Wiring/UKTelephone/Installation/Installation.html: Tools & Installation: TOLS, Feb. 24, 2008.

* cited by examiner

*Primary Examiner*—T C Patel
*Assistant Examiner*—Harshad C Patel
(74) *Attorney, Agent, or Firm*—Dority & Manning, P.A.

(57) ABSTRACT

An electrical insulation displacement connector includes a body having at least one channel with an open top side configured for receipt of an insulated conductive core wire therein. A contact element is fixed in the body with a first insulation displacement end defined by opposed blades oriented across the channel, and a second end extending from a bottom surface of the body and configured for electrical contact with a PCB. The body includes retaining structure extending into the channel at a location relative to a depth of the blades within the channel such that the insulation portion of a wire inserted into the channel and pressed down into the first end of the contact element is pushed below the retaining structure, thereby preventing the wire from being inadvertently pulled out from the first end of the contact.

18 Claims, 4 Drawing Sheets

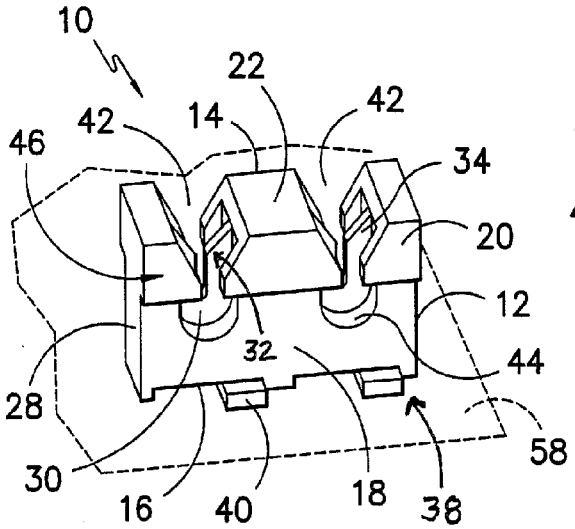
FIG. –1A–
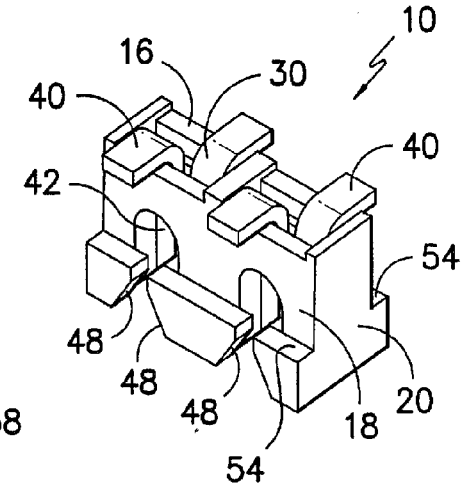
FIG. –1B–
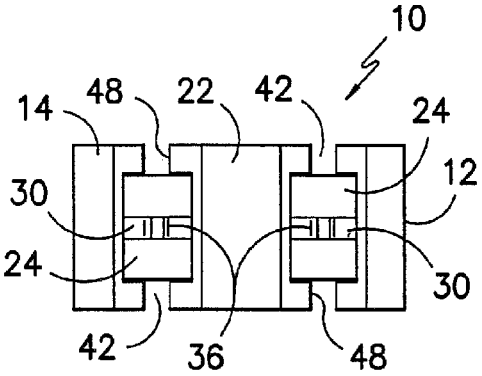
FIG. –1C–
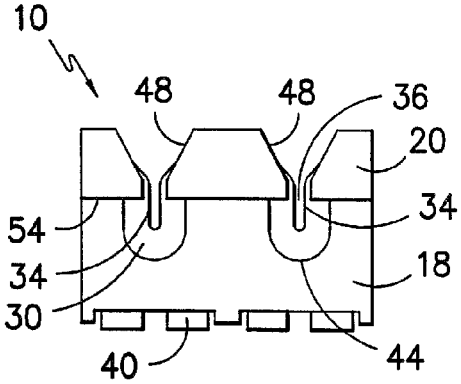
FIG. –1D–
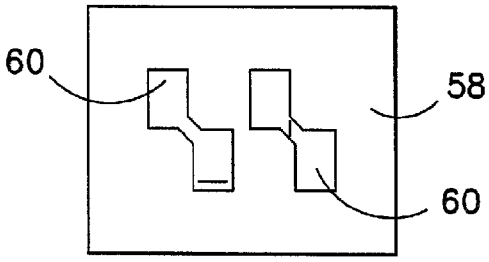
FIG. –1E–

INSULATION DISPLACEMENT CONNECTOR (IDC)

PRIORITY CLAIM

The present application claims priority to U.S. Provisional Application Ser. No. 61/038,889, filed Mar. 24, 2008.

FIELD OF THE INVENTION

The present invention relates generally to the field of electrical connectors, and more particularly to insulation displacement connectors (IDC) used to connect one or more insulated wires to a component, such as a printed circuit board (PCB).

BACKGROUND

Insulation displacement connectors (IDC) are well known in the art for forming connections between an insulated wire and any manner of electronic component. These connectors are typically available as sockets, plugs, and shrouded headers in a vast range of sizes, pitches, and plating options. A common feature of IDCs is one or more contact elements incorporating a set of blades or jaws that cut through the insulation around the wire and make electrical contact with the conductive core in a one-step process, thus eliminating the need for wire stripping and crimping, or other wire preparation. IDCs are used extensively in the telecommunications industry, and are becoming more widely used in printed circuit board (PCB) applications.

U.S. Pat. No. 6,050,845 describes an IDC assembly that can be mounted to a circuit board and secured thereto prior to terminating conductors to the connector. The electrical connector includes a housing having at least one conductor-receiving aperture and an associated terminal-receiving passageway extending from a board mounting face and intersecting each conductor-receiving aperture. A terminal is disposed in each terminal-receiving passageway and includes a body portion having a first connecting section extending from one end adapted to be inserted in a through-hole of a circuit board, and a pair of upstanding arms defining an IDC slot for receipt of a wire. Each terminal is partially inserted into the housing in a first position such that a portion of the terminal body and the first connecting section extends below the board mounting face of the housing. Upon positioning the first connecting sections in corresponding through-holes of a circuit board, the terminals can be secured to the board, after which ends of insulated conductors can be inserted into respective conductor-receiving apertures and terminated therein to respective terminals by moving the housing toward the board to a second position against the board and simultaneously pushing all the corresponding wires into respective IDC slots.

Attempts have been made to configure IDCs for surface mounting technology (SMT) applications as well. For example, U.S. Pat. No. 7,320,616 describes an IDC specifically configured for SMT mounting to a PCB. The connector assembly has at least one contact member with a piercing, cutting or slicing end that is slideably disposed within a main body, and a mounting end that extends from the main body and is attached to a printed circuit board using conventional SMT processes. An insulated conductor, such as a wire, cable and/or ribbon, is inserted in a channel in the main body without being pierced by the piercing end of the contact. When a user pushes down on the top portion of the main body, the contact slides into the channel and pierces the insulated conductor. The top portion of the main body also provides a surface for a vacuum pick-up nozzle in an automated pick-and-place assembly process.

The IDCs in the above cited references are relatively complicated in that they require all or a portion of the main body to be movable or slidable relative to the contacts to make final connection with the wires after ends of the contacts have been inserted into through holes in the PCB or surface mounted to the PCB. In addition, a perception to some in the industry is that IDCs are not well suited for stressful environments wherein the electrical component is subjected to prolonged shock and vibrations because the wires tend to move or pull out of the contact blades.

The present invention provides an improved IDC design that is rugged, reliable, and particularly well suited for SMT applications.

SUMMARY

Objects and advantages of the invention will be set forth in part in the following description, or may be obvious from the description, or may be learned through practice of the invention.

In accordance with aspects of the invention, an electrical insulation displacement connector is provided that is particularly well suited for connecting one or more insulated conductive core wires to a PCB. It should be appreciated, however, that connectors according to the invention are not limited to this use. The connector includes a body (also referred to in the art as a "molding") formed from any conventional insulator material. The body can take on various shapes and sizes, but generally includes a bottom surface, a top, longitudinally extending sidewalls, and longitudinal ends. The body has at least one channel defined therein with an open top such that a wire can be pressed into the channel from the top side of the connector body.

At least one contact element is fixed in the body. This element includes a first insulation displacement end oriented transversely across the channel. In a particular embodiment, this end is defined by opposed blades or jaws that define a slot or notch for receipt of the insulated wire therein. As understood by those skilled in the art, the slot is dimensioned such that when an insulated wire is pressed into the slot, the blades cut through the insulation and make electrical contact with the wire core. A second end of the contact element extends from a bottom surface of the body and is configured to make an electrical connection with another component. For example, the second end of the contact element may be configured to be pressed into a through-hole element of a circuit board. In another embodiment, the second end may be bent into an electrical contact tail that is configured to be soldered to a corresponding contact pad element on a circuit board. The method and configuration by which the connector is mated to another component is not a limiting factor of the inventive connector.

The body includes retaining structure that extends into the channel at a location relative to a depth of the blades within the channel such that the insulation portion of a wire that has been inserted into the channel and pressed down into the first end of the contact element is pushed below the retaining structure. The retaining structure thereby prevents the wire from being inadvertently pulled out or dislodging from the contact element, particularly if the connector is used in a high-vibration environment.

The retaining structure may take on various configurations. In one embodiment, the structure defines at least one pinch point at a location along the channel. Multiple pinch points may be provided. For example, the first end of the contact element may be flanked by pinch points defined by the retaining structure. The pinch points may be intermediate the side walls of the connector body, or may be outboard of the side walls.

In a particular embodiment, the retaining structure may include edges that form a V-shaped notch with an open apex aligned with a centerline axis of the channel. The insulation on the wire compresses when the wire in pressed into the channel and is pushed through the open apex. Once below the notch, the insulation "reforms" to essentially its original size, and the wire cannot be subsequently pulled back through the apex. The retaining edges may be defined on the outer face of each opposite sidewall of the body such that the channel extends between or is flanked by the retaining edges.

In a particular embodiment, the retaining structure may also include a ledge that extends generally transversely from the outer face of the body side walls.

As mentioned, the body may take on various shapes and sizes. In a unique embodiment, the body has a generally T-shaped cross-sectional profile, and the retaining structure is defined by a V-shaped access in the opposite header portions of the T-shaped profile with the channel defined between the V-shaped accesses.

Desirably, the connector is configured for conventional pick-and-place manufacturing processes. In this regard, the body may have at least one surface that is suited as a pick-up surface for vacuum nozzle. For example, an upper surface of the connector body may have sufficient surface area to serve as a pick-up surface.

The connector is not limited to any particular number of channels and associated retaining structure. In one embodiment, the connector is a two-wire connector and includes two channels and associated contact elements and retaining structure. The connector may be configured to accommodate three or more wires.

The present invention also encompasses a PCB assembly that includes one or more of the connectors discussed herein. For example, this assembly may include a printed circuit board having a contact pad or through-hole footprint defined thereon. At least one of the electrical insulation displacement connectors discussed above is mounted on the PCB. The second end of the contact elements extending from the connector body are configured for mating with the footprint on the PCB.

Particular embodiments of the unique insulation displacement connectors are described in greater detail below by reference to the examples illustrated in the drawings.

BRIEF DESCRIPTION OF THE DRAWINGS

FIG. 1A is a perspective view of an embodiment of a connector according to the invention mounted onto a circuit board.

FIG. 1B is a perspective bottom view of the connector illustrated in FIG. 1A.

FIG. 1C is a top view of the connector of FIG. 1A.

FIG. 1D is a side view of the connector of FIG. 1A.

FIG. 1E is a top view of the connector pad footprint on a circuit board to which a connector in accordance with aspects of the invention may be mounted.

DETAILED DESCRIPTION

Figure 2A:
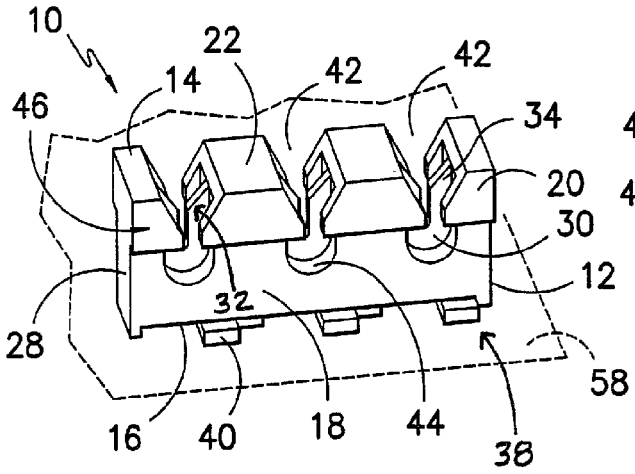
FIGS. 2A through 2E are views corresponding to FIGS. 1A through 1E for a 3-wire connector embodiment in accordance with aspects of the invention.
Figure 2B:
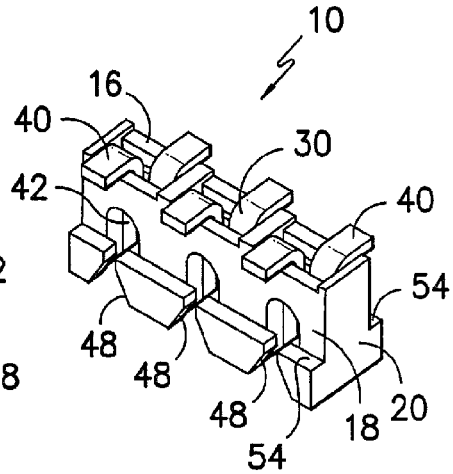
Figure 2C:
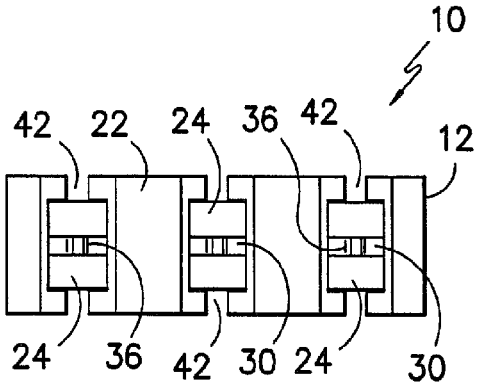
Figure 2D:
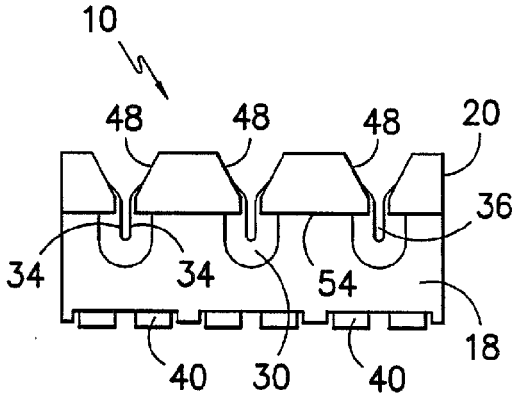
Figure 2E:
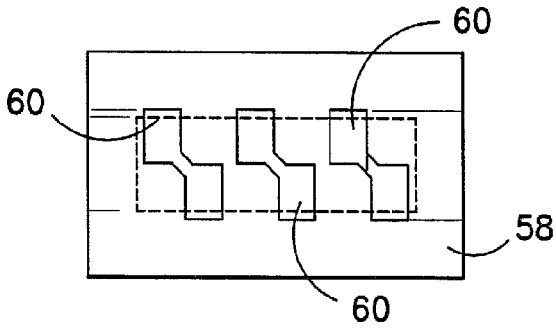
Figure 3A:
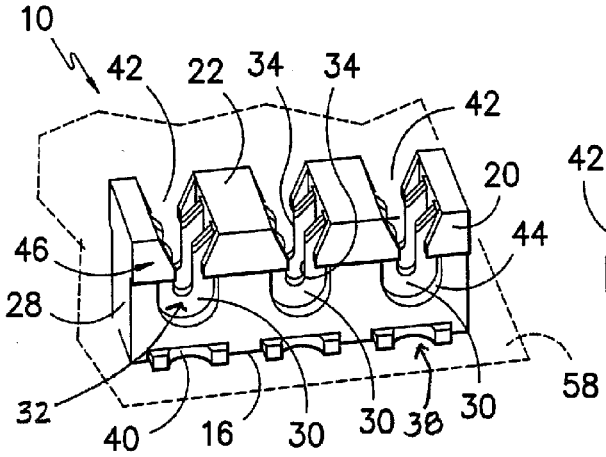
FIGS. 3A through 3E are views corresponding to FIGS. 1A through 1E for yet another embodiment of a 3-wire connector in accordance with aspects of the invention.
Figure 3B:
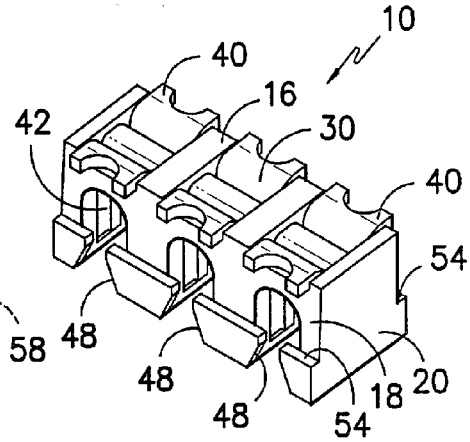
Figure 3C:
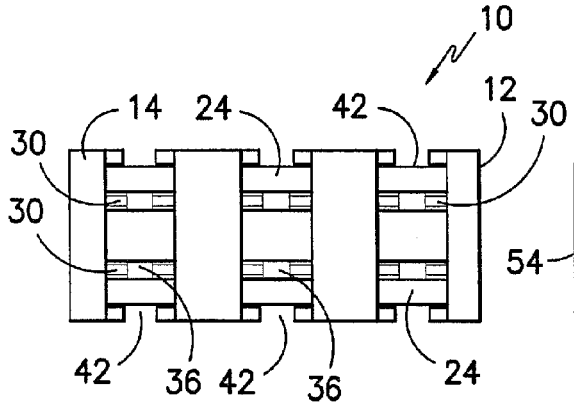
Figure 3D:
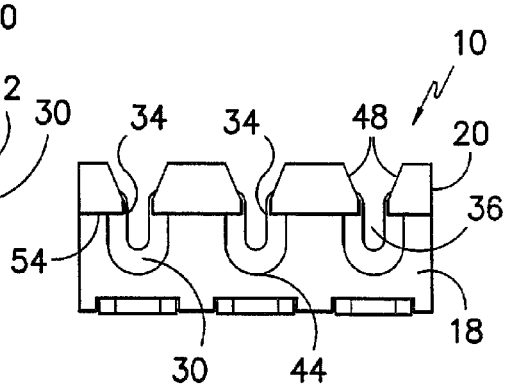
Figure 3E:
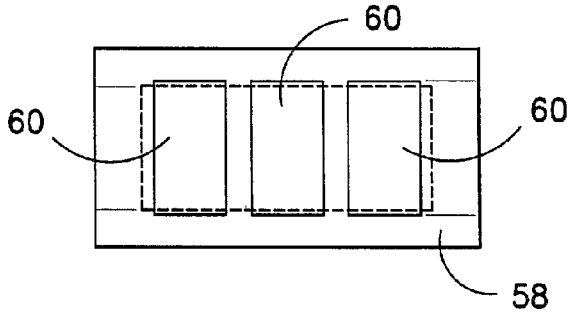

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

Referring to FIGS. 1A through 1E, an embodiment of an insulation displacement connector (IDC) connector 10 in accordance with aspects of the invention is illustrated. The connector 10 is illustrated in FIG. 1 as mounted on a printed circuit board (PCB) 58 by any conventional mounting technique. As discussed, the connectors 10 in accordance with the invention are particularly well suited for connecting one or more insulated conductive wires to a PCB 58. It should be appreciated, however, that connectors 10 are not limited to this use.

The connector 10 includes a body 12 (also referred to as a molding, or insulator) formed from any conventional insulator material, such as UL94VO polyester. Other suitable materials are also known in the art. The body 12 can take on various shapes and sizes, but generally includes a bottom 16, a top 14, sides 18, and ends 28. The body 12 has at least one channel 42 defined therein that is configured for receipt of an insulated conductive core wire that is pushed down into the channel 42 from an open top side of the channel. In the embodiment illustrated in FIGS. 1A through 1D, the connector 10 is configured as a 2-wire connector and includes two channels 42, with each channel 42 having an open top for receipt of a wire, and a bottom 44. In the illustrated embodiment, the channels 42 have a generally U-shaped profile, but are not limited to this particular profile.

At least one contact element 30 is fixed in the body 12. The contact element 30 is formed from any suitable electrically conductive material used in the art for connector contact elements, and includes a first insulation displacement end 32 that is oriented transversely across a respective channel 42. This end 32 is uniquely configured for making electrical contact with the conductive core of a wire pushed into the channel 42. In the illustrated embodiment, the end 32 includes opposed blades 34 that define a slot 36 for receipt of the insulated wire therein. As understood by those skilled in the art, the slot 36 is dimensioned such that when an insulated wire of a certain gauge is pressed into the slot, the blades 34 cut through the insulation and make electrical contact with the wire core. Thus, the slot 36 has a width that corresponds generally to the diameter of the conductive core of the wire. In the illustrated embodiments, the blades 34 define a generally U-shaped slot 36. However, this configuration of the blades 34 and slot 36 is not a limiting factor. Various configurations of contact elements used for insulation displacement connectors are known and understood by those skilled in the art, and any one of these configurations may be used in a connector 10 within the scope and spirit of the invention.

A second end 38 of the contact element 30 extends from the bottom surface 16 of the body 12, for example through an opening, slot, or other access in the body 12, that is configured to make an electrical connection with another component, for example the printed circuit board 58. The second end 38 may take on various configurations depending on the particular type of electrical connection to be made with the circuit board 58 or other component. For example, the second end 38 of the contact element 30 may be configured as a bayonet, post, or other type of male structure to be pressed into a through-hole connection in the circuit board 58. In the illustrated embodiment, the second end 38 of the contact elements 30 is bent or otherwise formed into a tail 40 that is configured to be soldered onto a corresponding contact pad element 60 (FIG. 1E) on the circuit board 58. These various types of connections are well known to those skilled in the art and need not be described in detail herein. It should be appreciated that the method and configuration by which the connectors 10 are mated to a circuit board 58 or other component is not a limiting factor of the invention.

In the embodiment illustrated in FIGS. 1A through 1E, a single contact element 30 is disposed in each channel 42. As described below with respect to other embodiments illustrated in the figures, multiple contact elements 30 may be disposed in each of the individual channels 42.

The body 12 includes retaining structure, generally 46, that extends into the channels 42. This retaining structure 46 serves to ensure that wires pressed into the channels 42 cannot be inadvertently pulled out or dislodged from the contact elements 30. The retaining structure 46 may take on various configurations for this purpose. In the illustrated embodiments, the retaining structure 46 extends transversely into the channels 42 at a location relative to a depth of the blades 34 within the channel 42 such that the insulation portion of a wire that has been inserted into the channel 42 and pressed down into the first end of the contact 30 between the blades 34 is pushed below the retaining structure 46. In certain embodiments, the retaining structure 46 may be configured so as to define a pinch-point at some location along the channel 42. Multiple pinch points may be provided along the channel 42 by multiple structures 46.

In a particular embodiment illustrated in the figures, the retaining structure 46 includes edges 48 that define a V-shaped notch having an open apex that is generally aligned with a centerline axis of the channel 42, as particularly seen in FIGS. 1A and 1D. The apex of this V-shaped notch defines a pinch point. The insulation on a wire compresses when the wire is pressed into the channel 42 and is pushed through the open apex. Once below the apex, the insulation essentially "reforms" to its original size, and the wire cannot be subsequently pulled back through the apex or pinch point defined by the edges 48.

The edge configuration may be defined anywhere along the channel 42. In the illustrated embodiment, the retaining edges 48 are defined on the outer face of each opposite side wall 18 of the body 12 such that the channel 42 extends between opposite pinch points or V-shaped notches defined by the retaining edges 48.

The edges 48 may lie in essentially the same plane as the side walls 18, or may extend laterally from the side walls 18 so as to define a ledge 54, as illustrated in the figures.

It is desirable that the connectors 10 be configured for conventional pick-and-place manufacturing processes wherein a vacuum nozzle is used to place the connectors 10 on a circuit board 58. In this regard, the body 12 desirably includes at least one surface having a sufficient surface area to serve as a pick-up surface for a vacuum nozzle. In the illustrated embodiment, the pick-up surface 22 is defined on the top 14 of the connector body 12 between adjacent channels 42. In this embodiment, the body has a generally T-shaped cross-sectional profile, with the header portion 20 being configured as the top of the connector 10 with the open top area of the channels 42 defined transversely across the header portion 20, as particularly illustrated in FIGS. 1A and 1D.

As mentioned, the connectors 10 are not limited to any particular configuration or number of contact elements 30 within any number or configuration of channels 42. FIGS. 2A through 2E illustrate an embodiment of the connectors 10 that is particularly configured for connecting three wires to the circuit board 58. The body 12 in this embodiment includes three channels 42 with a single contact element 30 within each channel. The remaining discussion of FIGS. 1A through 1E set forth above is relevant to the embodiment in FIGS. 2A through 2E.

FIGS. 3A through 3E define an alternative embodiment of a connector 10 wherein the body 12 includes three channels 42 for connecting three wires to circuit board 58. In this embodiment, however, each channel 42 includes two contact elements 30. Each of the contact elements 30 is configured as discussed above with respect to FIGS. 1A through 1E. The tail portion 40 of the contact elements 30 has a different configuration at the bottom 16 of the body 12, as particularly illustrated in FIG. 3B. The footprint of pads 60 on the PCB 58 (FIG. 3E) is correspondingly configured so that each of the contact elements within a single channel 42 are in electrical contact with a single pad 60 on the PCB 58, as can be particularly seen by the footprint in FIG. 3E.

In the various embodiments illustrated in the figures, the contact elements 30 are flanked on each side by a space 24 within the channels 42. These spaces 24 may be desirable in that they allow the insulation portion of the wire to reform along the opposite sides of the contact blades 34 so as to form a seal against the blades 34. This sealing configuration protects the electrical contact between the wire core and contact elements 30 from moisture, humidity, and the like.

Figure 4A:
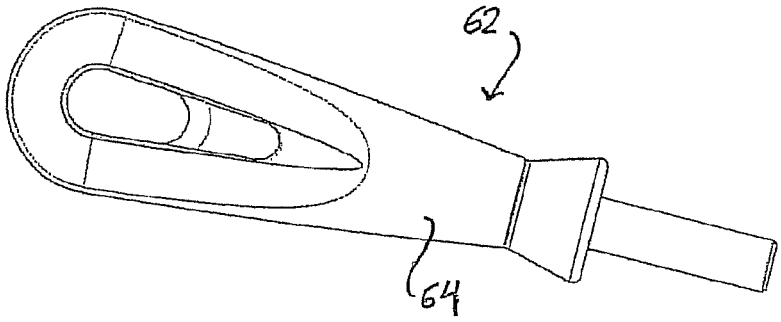
FIGS. 4A through 4C are perspective views of various embodiments of a tool that may be used for inserting wires into connectors in accordance with aspects of the invention.
Figure 4B:
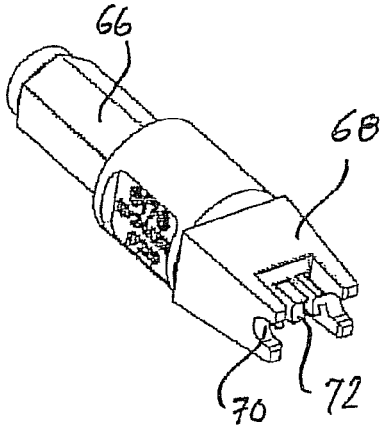
Figure 4C:
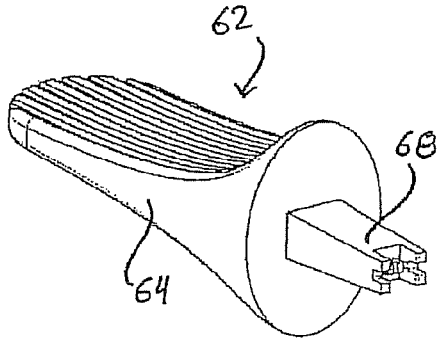

Insulated wires may be inserted into connectors 10 in accordance with aspects of the invention by different methods. A relatively simple process involves the use of a hand tool 62 (FIGS. 4A through 4C). The hand tool 62 includes a handle 64 that may accept a bit 66, as in the embodiment of FIGS. 4A through 4B. The bit 66 has a working or insertion end 68 having a profile that compliments the channel structure of an individual connector 10. This profile includes cut-outs 70 that extend down along the opposite side walls 18 of the connector body at the location of the channels 42. The cut-outs 70 have a shape that essentially matches the diameter of a wire intended to be pushed into the channel 42. An internal slotted prong 72 serves to push the insulated wire down into the slot 36 between the blades 34 to securely seat the wire within the contact element 30.

The tool 62 illustrated in FIG. 6 includes a handle 64 integrally formed with the insertion end 68, such that the tool 62 is a single component. This tool 62 would be designed for use with a single size connector 10 in that it does not have an exchangeable bit 66.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. An electrical insulation displacement connector, comprising:

a body having at least one generally U-shaped channel with an open top side configured for receipt of an insulated conductive core wire therein, said channel defined completely through said body such that the insulated conductive core wire passes through said body;

a contact element fixed in said body with a first insulation displacement end defined by opposed blades and a bottom oriented across said channel above a bottom of said U-shaped channel, said contact element including a second end extending from a bottom surface of said body and configured for electrical contact with a PCB;

said body comprising retaining structure extending into said channel at a location relative to a depth of said blades within said channel such that the insulation portion of a wire inserted into said channel and pressed down into said first end of said contact element is pushed below said retaining structure, thereby preventing the wire from being inadvertently pulled out from said first end of said contact, said retaining structure and channel configured relative to said blades such that the insulated conductive core wire is engaged by said blades and said bottom and passes through said channel in a straight linear path without contacting said channel.

2. The connector as in claim 1, wherein said retaining structure comprises retaining edges forming a V-shaped notch with an open apex aligned with a centerline axis of said channel through which the wire is pushed.

3. The connector as in claim 2, wherein said retaining edges are defined at each of opposite outer sidewall faces of said body such that said channel extends between said retaining edges, said retaining structure further comprising a ledge that extends generally transversely from said side walls.

4. The connector as in claim 1, wherein said body comprises a generally T-shaped cross-sectional profile, said retaining structure defined by a V-shaped access in opposite header portions of said T-shaped profile, said channel defined between said V-shaped accesses.

5. The connector as in claim 4, wherein an upper surface of said header portion defines a pick-up surface for a vacuum nozzle.

6. The connector as in claim 1, further comprising a space within said body at opposite sides of said first end of said contact element, said retaining structure defining a pinch point across said space through which the wire is pushed.

7. The connector as in claim 6, wherein said retaining structure is provided at opposite sidewalls of said body such that said first end of said contact element is disposed between opposite said pinch points.

8. The connector as in claim 1, wherein said second end of said contact element defines a foot configured for surface mounting to a pad on a PCB.

9. The connector as in claim 1, wherein said connector is a multi-wire connector and comprises a plurality of said contact elements and associated said channels and said retaining structure.

10. A printed circuit board (PCB) assembly, comprising:

a printed circuit board having a contact pad footprint defined thereon;

at least one electrical insulation displacement connector mounted on said PCB, said connector further comprising:

a body having at least one generally U-shaped channel with an open top side configured for receipt of an insulated conductive core wire therein, said channel defined completely through said body such that the insulated conductive core wire passes through said body;

a second end extending from a bottom surface of said body and a contact element fixed in said body with a first insulation displacement end defined by opposed blades and a bottom oriented across said channel above a bottom of said U-shaped channel, said contact element including a second end extending from a bottom surface of said body and comprising a tail configured in electrical contact with said contact pad footprint;

said body comprising retaining structure extending into said channel at a location relative to a depth of said blades within said channel such that the insulation portion of a wire inserted into said channel and pressed down into said first end of said contact element is pushed below said retaining structure, thereby preventing the wire from being inadvertently pulled out from said first end of said contact, said retaining structure configured relative to said blades and said channel such that the insulated conductive core wire is engaged by said blades and said bottom and passes through said channel in a straight linear path without contacting said channel.

11. The PCB assembly as in claim 10, wherein said retaining structure comprises retaining edges forming a V-shaped notch with an open apex aligned with a centerline axis of said channel through which the wire is pushed.

12. The PCB assembly as in claim 11, wherein said retaining edges are defined at each of opposite outward sidewall faces of said body such that said channel extends between said retaining edges, said retaining structure further comprising a ledge that extends generally transversely from said side walls.

13. The PCB assembly as in claim 10, wherein said body comprises a generally T-shaped cross-sectional profile, said retaining structure defined by a V-shaped access in opposite header portions of said T-shaped profile, said channel defined between said V-shaped accesses.

14. The PCB assembly as in claim 13, wherein an upper surface of said header portion defines a pick-up surface for a vacuum nozzle.

15. The PCB assembly as in claim 10, further comprising a space within said body at opposite sides of said first end of said contact element, said retaining structure defining a pinch point across said space through which the wire is pushed.

16. The PCB assembly as in claim 15, wherein said retaining structure is provided at opposite sidewalls of said body such that said first end of said contact element is disposed between opposite said pinch points.

17. The PCB assembly as in claim 10, wherein said second end of said contact element defines a foot configured for surface mounting to a pad on a PCB.

18. The PCB assembly as in claim 10, wherein said connector is a multi-wire connector and comprises a plurality of said contact elements and associated said channels and said retaining structure.

* * * * *